US005865004A

United States Patent [19]

Mitchell

[11] Patent Number: 5,865,004

[45] Date of Patent: Feb. 2, 1999

[54] RECREATIONAL SURFACE BLOCK LOCKING SYSTEM

[75] Inventor: Steven G. Mitchell, Yorba Linda, Calif.

[73] Assignee: SpectraTurf, Inc., Corona, Calif.

[21] Appl. No.: 783,554

[22] Filed: Jan. 14, 1997

Related U.S. Application Data

[63] Continuation-in-part of Ser. No. 497,017, Jun. 30, 1995, Pat. No. 5,713,175, and a continuation-in-part of Ser. No. 748,689, Nov. 13, 1996, which is a continuation-in-part of Ser. No. 611,710, Mar. 6, 1996, abandoned.

[51] Int. Cl.[6] ..... E01C 5/18; E04B 5/00

[52] U.S. Cl. ..... 52/582.1; 52/177; 52/506.05; 52/513; 52/585.1; 403/294; 403/386; 428/327

[58] Field of Search ..... 52/177, 181, 391, 52/390, 403.1, 465, 470, 471, 480, 506.01, 506.05, 509, 513, 582.1, 585.1, 586.1, 587.1; 108/64, 65, 185; 403/291, 292, 294, 386, 388, 392, 397; 428/147, 195, 327

[56] References Cited

U.S. PATENT DOCUMENTS

| | | | |
|---|---|---|---|
| 905,189 | 12/1908 | Hyke | 52/582.1 |
| 1,266,981 | 5/1918 | Olesen | 108/185 |
| 2,341,777 | 2/1944 | Hensel | 52/509 X |
| 2,999,431 | 9/1961 | Mitchell | 52/392 X |
| 3,563,578 | 2/1971 | Meller . | |
| 3,780,481 | 12/1973 | Tomkins . | |
| 3,943,674 | 3/1976 | Ray . | |
| 3,982,364 | 9/1976 | Horvath . | |
| 4,447,998 | 5/1984 | Griffin . | |
| 4,578,910 | 4/1986 | Germeroth et al. | 52/509 X |
| 4,638,618 | 1/1987 | Iesaka et al. | 52/509 |
| 4,848,058 | 7/1989 | Mullen . | |
| 4,956,956 | 9/1990 | Maier et al. . | |
| 5,038,535 | 8/1991 | Praag, III . | |
| 5,182,886 | 2/1993 | Bateman . | |
| 5,298,217 | 3/1994 | Mitchell | 404/32 X |
| 5,403,637 | 4/1995 | Pickard et al. | 52/177 X |
| 5,428,935 | 7/1995 | Mitchell | 52/506.05 X |
| 5,509,244 | 4/1996 | Bentzon | 52/586.1 X |
| 5,531,539 | 7/1996 | Crawford . | |

*Primary Examiner*—Carl D. Friedman
*Assistant Examiner*—Kevin D. Wilkens

[57] ABSTRACT

A molded rubber recreational block locking system, wherein a molded rubber recreational surface block includes an upper surface and a resilient supporting structure below the upper surface. At least one recessed shoulder is located below the upper surface and intersects a marginal edge of the molded rubber recreational surface block. A fastening device interconnects adjacently positioned recessed shoulders in adjacent molded rubber recreational surface blocks for securing same together. Typically, at least one generally vertically directed through hole extends through each recessed shoulder and a flexible fastening device, such as a fastening strap, interconnects the through holes of adjacently positioned recessed shoulders in adjacent molded rubber recreational surface blocks. A cap covers the fastening device and recessed shoulders of adjacently positioned molded rubber recreational surface blocks.

19 Claims, 5 Drawing Sheets

RECREATIONAL SURFACE BLOCK LOCKING SYSTEM

CROSS-REFERENCE TO RELATED APPLICATIONS

This is a continuation-in-part of utility patent application Ser. No. 08/497,017, filed Jun. 30, 1995 entitled PROTECTIVE FLOORING, now U.S. Pat. No. 5,713,175, as well as a continuation-in-part of utility patent application Ser. No. 08/748,689 filed Nov. 13, 1996 entitled RECREATIONAL SURFACE BLOCK AND PROCESS FOR MAKING SAME, which was a continuation-in-part of Ser. No. 08/611,710 filed Mar. 6, 1996 entitled RECREATIONAL SURFACE BLOCK AND PROCESS FOR MAKING SAME, now abandoned.

STATEMENT REGARDING FEDERALLY SPONSORED RESEARCH OR DEVELOPMENT

Not applicable.

BACKGROUND OF THE INVENTION

Children love to use playground equipment; however, as can be appreciated, the exuberance of children sometimes results in a mishap causing the child to fall from the playground equipment. Sometimes also, children simply slip and fall on the playground surface itself. As disclosed in my aforementioned U.S. Pat. No. 5,713,175, safety playground surfaces prevent or minimize playground injuries. Those playground safety surfaces that are formed from resilient and shock absorbing cushion elements have been found to reduce the possibility of injury due to a child falling from various heights of playground equipment or from slipping and falling. In the construction shown in my aforementioned patent, a series of recreational surface blocks or floor segments are connected together through complementary fastener units provided on adjacent recreational surface blocks, in order to hold a series of such recreational surface blocks together as protective flooring. Such interlocked recreational surface blocks or floor segments produce a protective cushioned area for playground surfaces, except in the areas where they are connected together. In my aforementioned patent, the complementary fastener units provided on adjacent recreational surface blocks are formed as injection molded units and thus are somewhat rigid and unyielding. As a result, it is possible that a child could be injured if the child falls in the area of such rigid or unyielding fastener units that interconnect adjacent recreational surface blocks. In actuality, my previous locking system was safe in the area of the injection molded units, but as much lower fall heights than the rest of the protective surfacing.

It has been discovered that a fastening device, such as one or more flexible fastening straps, can be effectively utilized to secure adjacent recreational surface blocks together while at the same time avoiding injury to a child who might fall on or near such fastening device. A shock absorbing cap can also be used to overlie the fastening device, thus providing a further safety cushioning feature for use with the resilient shock absorbing recreational surface block. As a result, the new protective surfacing system with flexible fastening straps and the shock absorbing cap has an equivalent safety level over the entire protective surfacing. As an added advantage, a fastening device having one or more fastening straps can be used to easily assemble recreational surface blocks together without the need for tools, thus facilitating assembly while minimizing costs.

As will be appreciated from the discussion that follows, the aforementioned novel features are embodied in a number or different variations, as will become more apparent in the ensuing description.

BRIEF SUMMARY OF THE INVENTION

Among the several objects and advantages of the present invention include:

A new and improved recreational surface block locking system;

The provision of a new and improved fastening device or locking system for recreational surface blocks;

The provision of the aforementioned fastening device or locking system which may include one or more fastening straps such as cable ties or the like;

The provision of the aforementioned fastening device or locking system which has a flexible and yieldable construction while still effectively securing the recreational surface blocks together;

The provision of the aforementioned fastening device in which one or more fastening straps extend into through holes of recessed shoulders provided adjacent the marginal edges and/or of the recreational surface block;

The provision of a recreational surface block locking system including a plurality of recessed shoulders extending around the marginal edges including corners of the recreational surface blocks, the recessed shoulders having one or more through holes for receiving a fastening strap that secures adjacent recreational surface blocks together at a plurality of spaced positions;

The provision of the aforementioned recreational surface block locking system which further includes a shock absorbing cap that provides a safety cushioning feature overlying the fastening device; and The provision of the aforementioned recreational surface block locking system which can be efficiently and economically manufactured through known rubber molding techniques; incorporates features to facilitate use with fastening straps that enable assembly to be performed without the use of tools; provides a long wearing and durable shock absorbing safety playground surface; and is otherwise well adapted for the purposes intended.

Briefly stated, a molded rubber recreational surface block includes an upper surface and a resilient supporting structure below the upper surface. At least one recessed shoulder is located below the upper surface and intersects a marginal edge of the molded rubber recreational surface block. A fastening device interconnects adjacently positioned recessed shoulders in adjacently molded rubber recreational surface blocks for securing same to each other.

Each recessed shoulder includes at least one generally vertically directed through hole extending through its associated recessed shoulder for receiving a flexible fastening device that interconnects the through hole of adjacently positioned recessed shoulders in adjacent molded rubber recreational surface blocks. In some instances, there are two or even three through holes in some recessed shoulders, each through hole receiving an associated fastening device.

Preferably, each fastening device comprises a fastening strap that extends through one through hole of each of the adjacently positioned recessed shoulders in adjacently positioned recreational surface blocks. Preferable, there are two fastening straps extending through corresponding through holes in the recessed shoulders, the fastening straps being positioned in crossover superimposed relationship relative to one another.

For each molded rubber recreational surface block, there are a plurality of recessed shoulders each having at least one through hole. Where the rubber recreational surface block has a polygonal configuration, the plurality of recessed shoulders may be located between as well as in proximity to the intersection or come between two marginal edges of the polygonally configured recreational surface block.

A cap is desirably used for covering adjacently positioned recessed shoulders in adjacent molded rubber recreational surface blocks, the cap having an upper cap surface that is positioned in general alignment with the upper surfaces of adjacently molded rubber recreational surface blocks. The cap includes shock absorbing elements that engage the adjacently positioned recessed shoulders of adjacently positioned recreational surface blocks preferably outside of the fastening straps. Thus, the cap has an outer shock absorbing element that engages the adjacently positioned recessed shoulders or adjacently positioned surface blocks outside of the fastening straps. The cap may include an inner shock absorbing element spaced upwardly from adjacently positioned shoulders that engages such shoulders only upon the application of sufficient compressive force. Both the inner and outer shock absorbing elements preferably comprise vertical struts formed in the cap.

These and other objects and advantages of the present invention will become apparent from the description that follows.

BRIEF DESCRIPTION OF THE SEVERAL VIEWS OF THE DRAWINGS

In the drawings.

Corresponding reference numerals will be used throughout the various figures of the drawings.

DETAILED DESCRIPTION OF THE INVENTION

Figure 1:
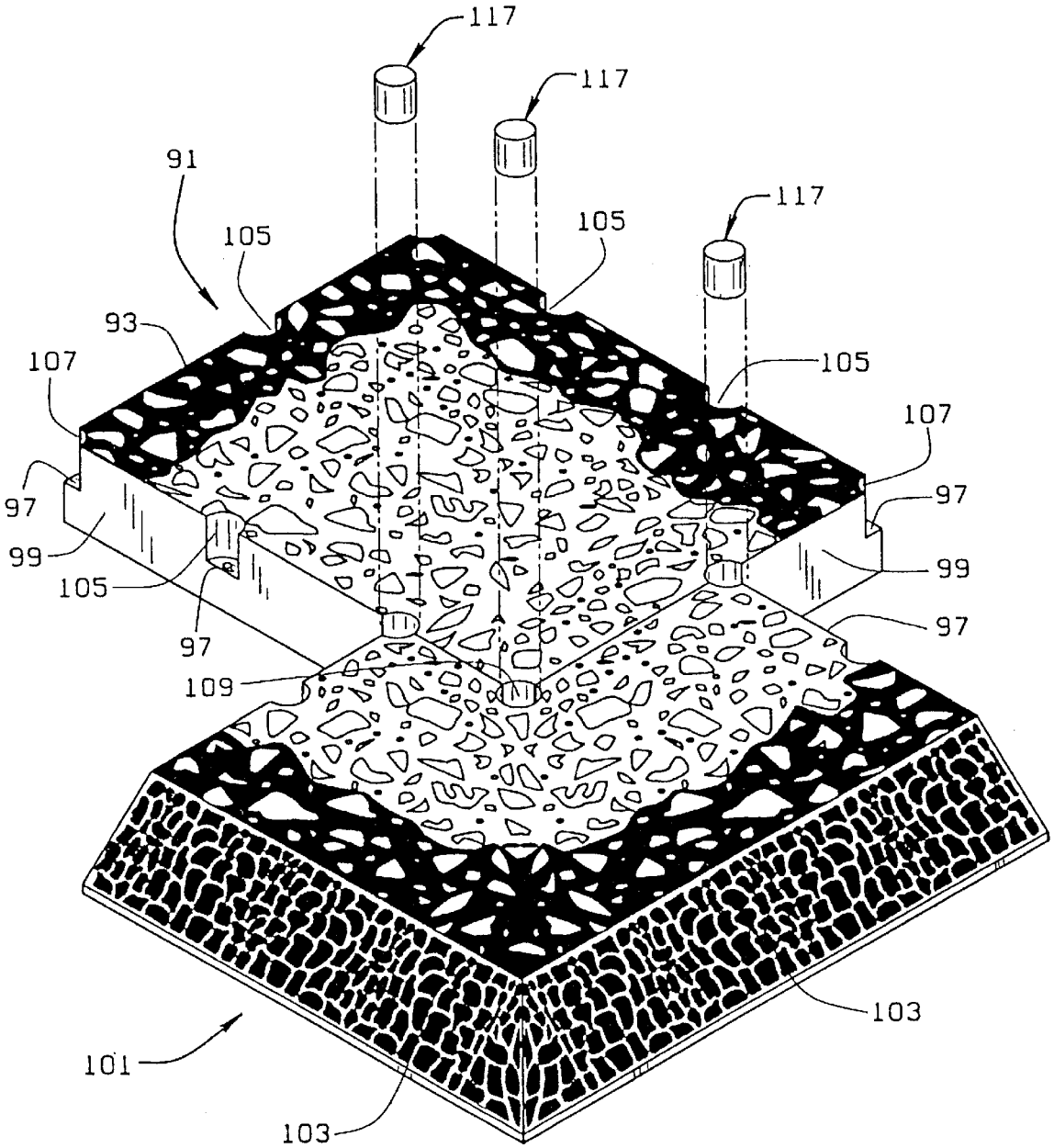
FIG. 1 is a partial exploded perspective view of adjacently positioned recreational surface blocks that are secured together using the locking system of the present invention.

The following detailed description illustrates the invention by way of example and not by way of limitation. This description will clearly enable one skilled in the art to make and use the invention, and describes several embodiments, adaptations, variations, alternatives and uses of the invention, including what I presently believe is the best mode of carrying out the invention.

The recreational surface block 91 illustrated in FIGS. 1–11 of the drawings is of the type illustrated in my aforementioned co-pending patent application Ser. No. 08/748,689 filed Nov. 13, 1996 entitled RECREATIONAL SURFACE BLOCK AND PROCESS FOR MAKING SAME. Specifically, the recreational surface block includes a black molded rubber base with randomly interspersed polygonally shaped lighter through color granules that are exposed from at least one surface of the base, typically the upper surface. The base includes a black molded and vulcanized rubber block with pre-vulcanized polygonally shaped lighter through color granules that are randomly dispersed throughout the base and exposed in at least an upper surface of the base. In order to fully expose the polygonally shaped lighter through color granules, a predetermined thickness may be removed from an upper surface on the block to provide an attractive upper surface appearance in a resilient and durable supporting structure.

The present invention is concerned with securing adjacent recreational surface blocks to one another, either along side marginal edges and/or corners of the recreational surface block, as will become apparent.

The molded rubber recreational surface block 91 shown in FIGS. 1–4 of the drawings includes an upper surface 93 with a resilient supporting structure 95 (see FIG. 3) below the upper surface 93. The resilient supporting structure 95 typically is a honeycomb cell resilient supporting structure that affords resiliency and shock absorbing characteristics to the molded rubber recreational surface block 91.

At least one and preferably a plurality of recessed shoulders 97 are formed in the molded rubber recreational surface block 91 located below the upper surface 93 and intersecting a marginal edge 99 that surrounds the molded rubber recreational surface block 91. Since the molded rubber recreational surface block 91 is preferably polygonally shaped, there are also a series of marginal edges which intersect at corners, and it will be seen that a recessed shoulder 97 is formed in each of the four corners of the rectangular shaped molded rubber recreational surface block 91.

Figure 11:
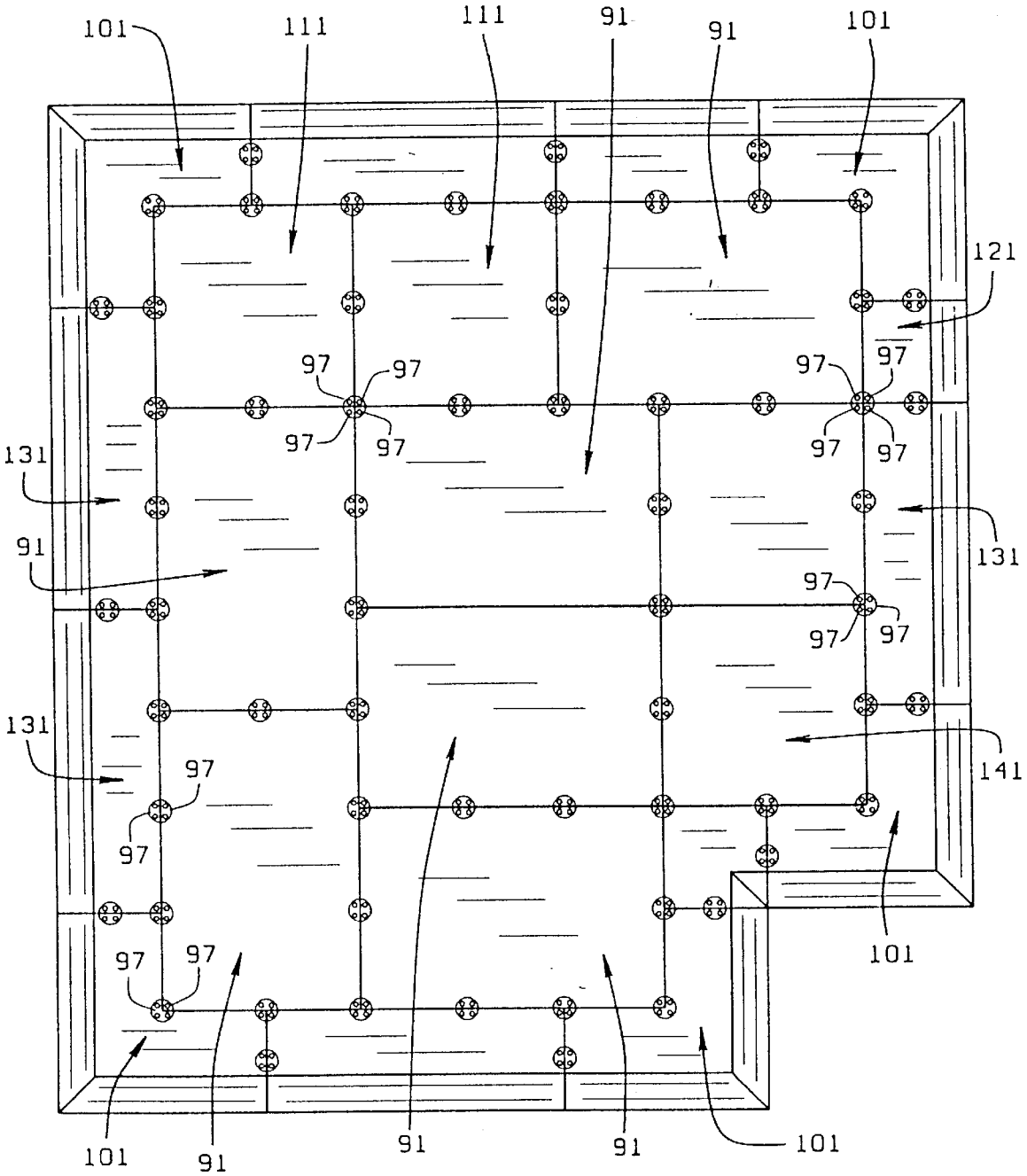
FIG. 11 is a top plan view of a series of recreational surface blocks of various shapes assembled to one another in one floor pattern arrangement and illustrating the manner in which the locking system of the present invention can be used to secure the adjacently positioned recreational surface blocks together.

FIG. 1 also illustrates a second molded rubber recreational surface block 101 that serves as a corner recreational surface block in a floor pattern arrangement such as shown in FIG. 11 of the drawings. It will be appreciated that the corner block 101 is formed in a manner similar to the rectangular shaped molded rubber recreational surface block 91, except with respect to the specific corner design shown in FIGS. 1 and 11. Note that the outer or perimeter of the corner recreational surface block 101 has a pebble grained exterior surface 103 to provide a finished surface appearance in a floor pattern arrangement, such as the one shown in FIG. 11 of the drawings.

While the molded rubber recreational surface block of the present invention may be formed in a variety of different shapes and designs, typically there are several different repeat shapes that are desirably used in forming a particular floor pattern arrangement. Thus, as shown in FIG. 11 of the drawings, the rectangular surface block 91 and the corner surface block 101 are illustrated along with a square shaped surface block 111, a smaller rectangular surface block 121 and an elongated edge or perimeter surface block 131. Of course, other shapes can be formed in order to produce a desired floor arrangement such as the one shown in FIG. 11 of the drawings.

Figure 2:
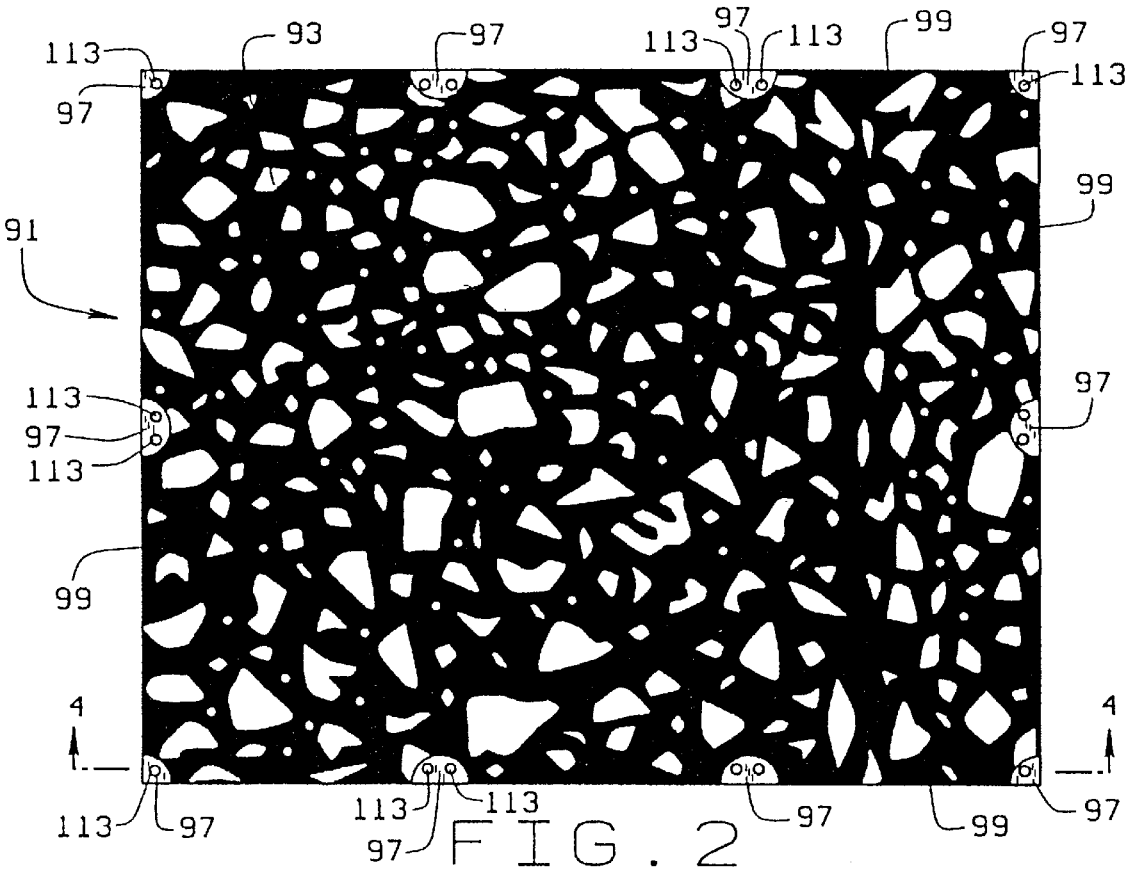
FIG. 2 is a top plan view of a polygonal or rectangularly shaped recreational surface block embodying the features of the present invention.
Figure 3:
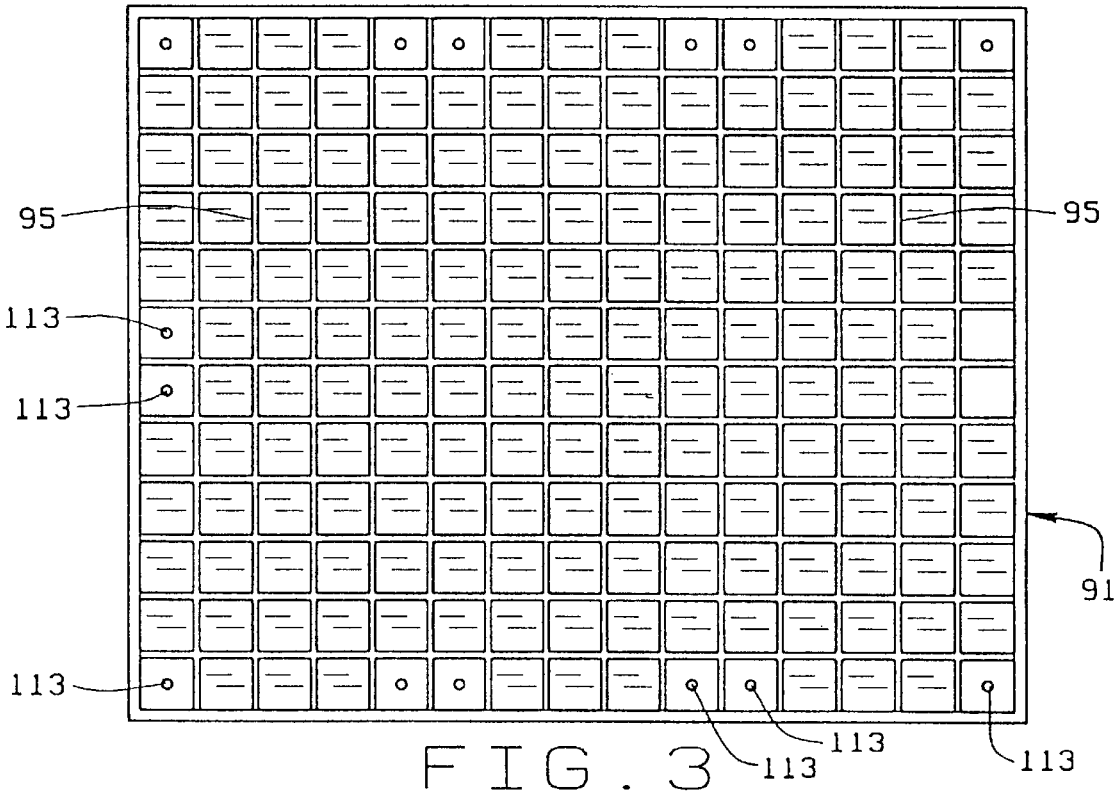
FIG. 3 is a bottom plan view of the recreational surface block shown in FIG. 2.
Figure 4:
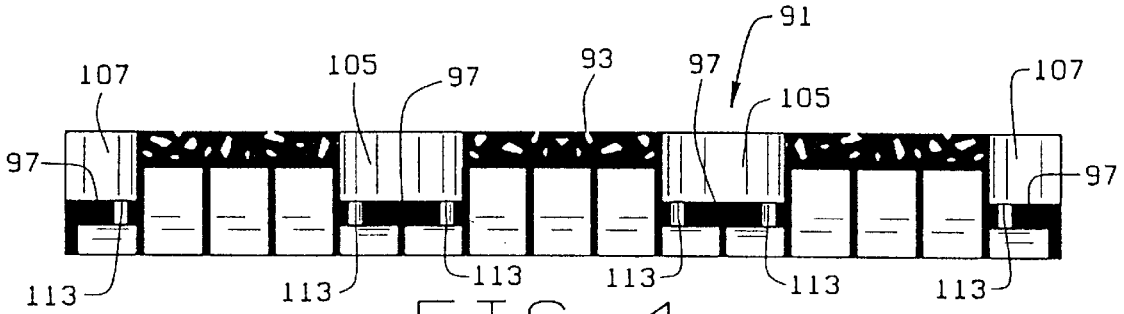
FIG. 4 is a sectional view of the recreational surface block as shown along lines 4—4 of FIG. 2.
Figure 5:
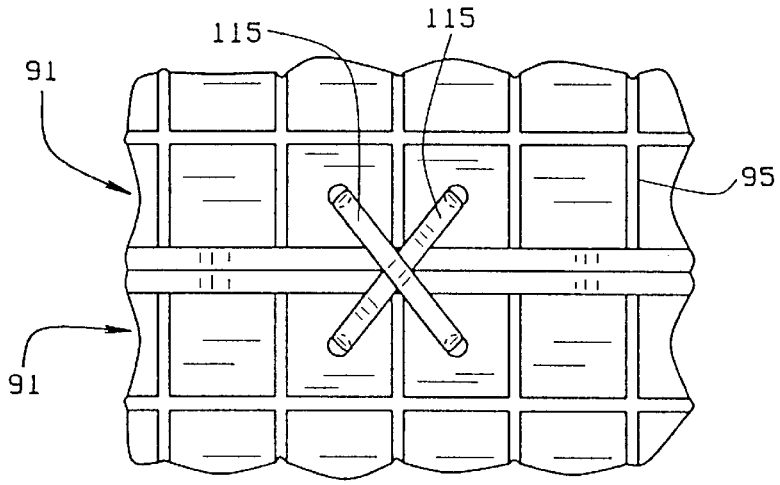
FIG. 5 is a fragmentary bottom plan view of a pair of adjacently positioned recreational surface blocks shown as being secured together by superimposed fastening straps utilized in the locking system of the present invention.

As best illustrated in FIGS. 1 and 2 of the drawings, a series of recessed shoulders 97 are formed in the molded rubber recreational surface block 91. Along the marginal edges 99 of the molded rubber recreational surface block 91, for example, a semi-cylindrical opening 105 intersects its associated marginal edge 99 and terminates at its lower end in the recessed shoulder 97. At the corners of the molded rubber recreational surface block 91, a recessed shoulder 97 is formed from a quarter cylindrically-shaped opening 107 that is formed at the corner of the intersecting marginal edges 99, 99 of the corner portions. Thus, the recessed shoulder 97, formed by the semi-cylindrically shaped openings 105, has a semi-cylindrical shape while the corner recessed shoulders 97, formed by the quarter cylindrically shaped opening 107 has a quarter cylindrical-shape.

The recessed shoulders 97 may have other shapes, as well. As shown in FIG. 11 of the drawings, the corner surface block 101 shows the corner recessed shoulder 97 as forming a three quarters-cylindrical shape that would be formed by a three quarters cylindrically shaped recessed opening 109 shown in FIGS. 1 and 11 of the drawings. The different shaped recessed shoulders 97 in the various molded surface blocks 91, 101, 111, 121 and 131 enable the various molded surface blocks to be secured to one another, as will discussed further below.

Each of the recessed shoulders 91 has at least one generally vertically directed through hole 113 that extends through each recessed shoulder 97. The purpose of the generally vertically directed through hole 113 is to enable a fastening strap, typically in the form of a cable tie 115, to extend into the through holes 113 of adjacently positioned recessed shoulders 97, 97 in adjacently molded rubber recreational surface blocks for securing same together.

In order to understand how the fastening straps 115 extend into the through holes 113 of adjacently positioned recessed shoulders 97 in adjacent molded rubber recreational surface blocks, attention is directed to FIGS. 5–11 of the drawings. First of all, it should be noted that the fastening straps 115, 115 are typically positioned in crossover superimposed relationship to one another and extend into the through holes 113 of adjacently positioned recessed shoulders 97, 97 in adjacent molded rubber recreational surface blocks. It has been found that this crossover superimposed connection affords strength and rigidity while resisting torsional movement between adjacent molded rubber recreational surface blocks.

Figure 6:
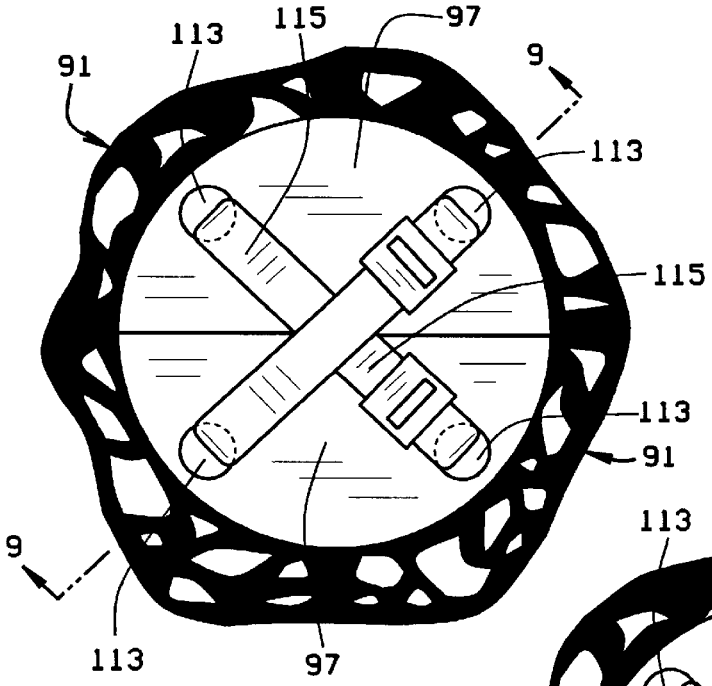
FIG. 6 is a fragmentary top plan view of a pair of adjacently positioned recreational surface blocks which are secured together by superimposed fastening straps along one marginal edge.

The crossover superimposed fastening straps or cable ties 115, 115 may be used in securing the semi-cylindrically shaped recessed shoulders 97, 97 of adjacent molded rubber recreational surface blocks as shown in FIG. 6 of the drawings. In this instance, it is simply necessary to align the semi-cylindrically shaped recessed shoulders 97, 97 of adjacent molded rubber recreational surface blocks 91, 91, for example, in order to allow a workman to insert the fastening straps or cable ties 115, 115 in the crossover superimposed relationship shown in FIG. 6 of the drawings for securing the adjacent molded rubber recreational surface blocks 91, 91 together.

Figure 7:
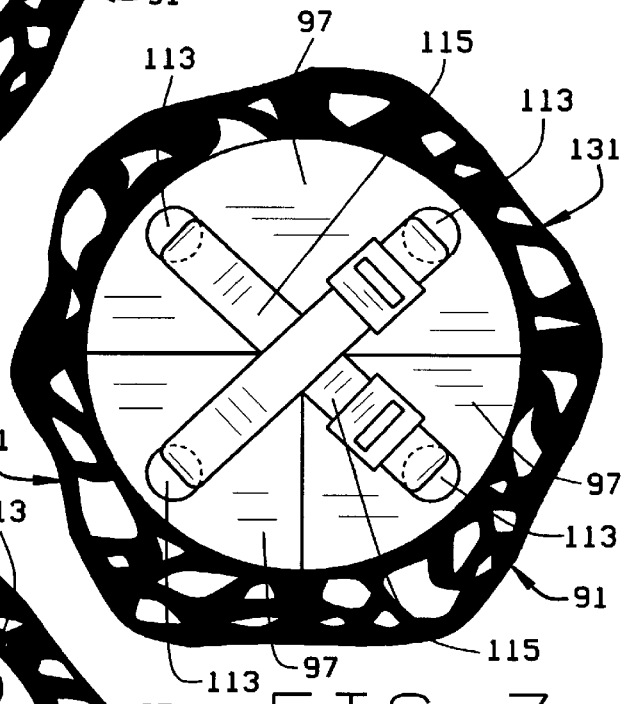
FIG. 7 is an enlarged fragmentary top plan view of three recreational surface blocks joined together along two corners and one marginal edge of the three respective recreational surface blocks.

FIG. 7 illustrates three recessed shoulders 97, 97, 97 of three molded rubber recreational surface blocks 91, 91, 131, for example. In this instance, the corner recessed shoulders 97, 97 of the molded rubber recreational surface blocks 91, 91 are positioned in proximity to the semi-cylindrically shaped recessed shoulder 97 of the molded rubber recreational surface block 131, thus enabling the fastening straps or cable ties 115, 115 to be passed through the through holes 113 of the corresponding molded rubber recreational surface blocks in order to secure same together.

Figure 8:
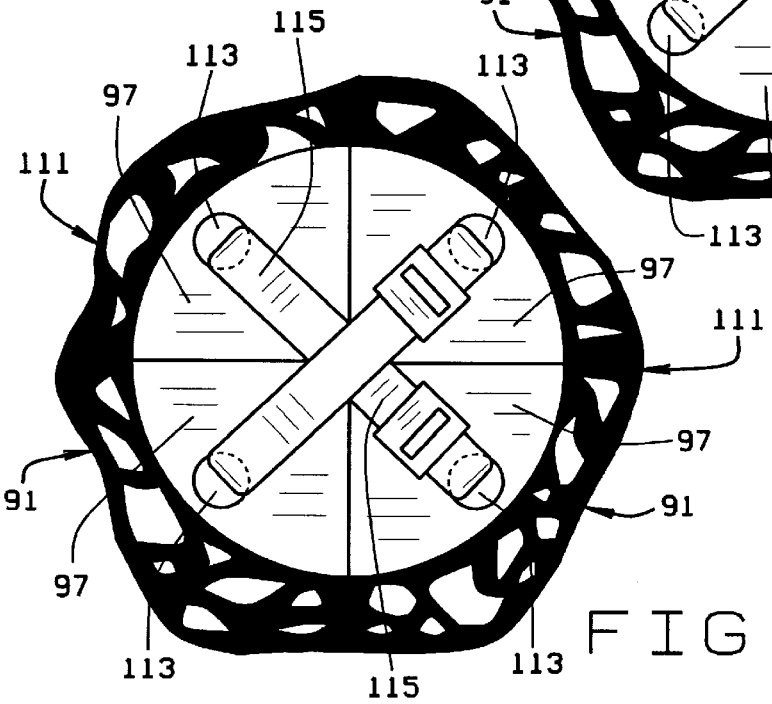
FIG. 8 is an enlarged fragmentary top plan view of four adjacently positioned surface blocks and illustrating the superimposed fastening straps securing the corners of the four adjacently positioned recreational surface blocks together.

FIG. 8 of the drawings illustrates an arrangement where four corner recessed shoulders 97 of molded rubber recreational surface blocks 111, 111, 91, 91, for example, are secured together by the fastening straps 115, 115. As illustrated, the four quarter cylindrically shaped recessed shoulders 97, 97, 97, 97 are correspondingly aligned with one another to enable the fastening straps 115, 115 to be passed into the through holes 113 for securing the molded rubber recreational surface blocks 111, 111, 91, 91 together.

It will be appreciated that other shapes of recessed shoulders may be formed and arranged in a variety of different ways in order to enable adjacent molded rubber recreational surface blocks to be secured to one another.

Figure 9:
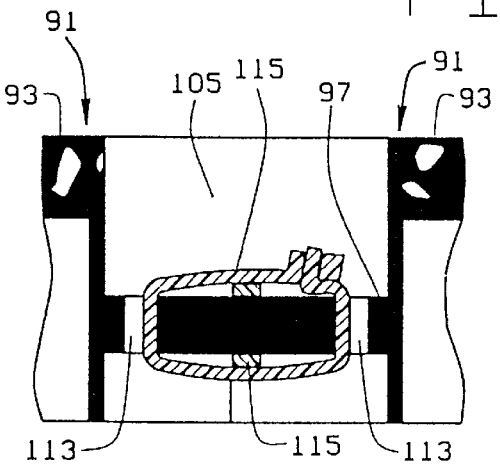
FIG. 9 is a fragmentary sectional view illustrating the fastening straps as securing adjacently positioned recreational surface blocks together, as viewed along line 9—9 of FIG. 6.
Figure 10:
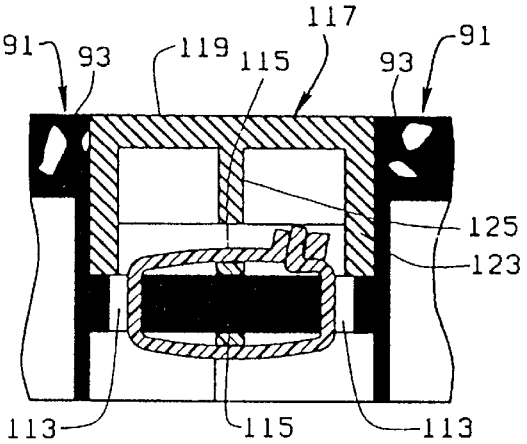
FIG. 10 is a fragmentary sectional view similar to FIG. 9, but illustrating the use of a shock absorbing cap overlying the fastening straps that extend between two adjacently positioned recreational surface blocks.

FIGS. 9–10 of the drawings illustrate how each fastening strap 115 extends through a pair of through holes 113, 113 in adjacent molded rubber recreational surface blocks 91, 91. As will be seen, the fastening strap 115, effectively secures and draws up tight the adjacent molded rubber recreational surface blocks 91, 91 together. However, this still leaves a cylindrically shaped opening, formed by the semi-cylindrically shaped openings 105, 105 of the adjacent molded rubber recreational surface blocks 91, 91. In order to close off this opening, a cap 117 is provided. The cap 117 has an upper surface 119 that is generally aligned with the upper surfaces 93, 93 of the adjacent molded rubber recreational surface blocks 91, 91. This is due to the fact that the cap 117 includes an outer generally cylindrically shaped vertical strut 123 having a lower end that rests on the recessed shoulders 97, 97 of the adjacent molded rubber recreational surface blocks 91, 91. There is also an inner vertical strut 125, generally linear in shape, which is spaced upwardly from the recessed shoulders 97, 97. Both the inner and outer vertical struts 125, 123 serve as shock absorbing elements, although not at the same time. In this regard, the outer cylindrically shaped vertical strut 123, since it is engagement with the recessed shoulders 97, 97, will provide initial shock absorption upon the application of sufficient compressive force, such as when a child steps upon or falls upon a cap 117. The inner vertical strut 125 also serves as a shock absorbing element; however, because it is spaced upwardly from the recessed shoulders 97, 97, it comes into operation only after the initial compressive force. The second vertical strut or shock absorbing element 125 thus serves to enhance the first or outer vertical or shock absorbing element 123 by resisting collapse of the cap element, upon the application of sufficient compressive force.

From the foregoing, it will now be appreciated that the recreational surface block locking system of the present invention provides a flexible construction while effectively securing molded rubber recreational surface blocks together. The use of one or more fastening straps to extend into through holes of recessed shoulders, provided adjacent the marginal edges and/or corners of adjacent recreational surface blocks, facilitates assembly without the use of tools while providing an effective fastening structure in a long wearing and durable shock absorbing safety playground surface comprised of a series of adjacently molded rubber recreational surface blocks.

In view of the above, it will be seen that the several objects and advantages of the present invention have been achieved and other advantageous results have been obtained.

As various changes could be made in the above constructions without departing from the scope of the invention, it is intended that all matter contained in the above description or shown in the accompanying drawings shall be interpreted as illustrative and not in a limiting sense.

I claim:

1. A plurality of molded rubber recreational surface blocks each including:

an upper surface;

a resilient supporting structure below the upper surface;

at least one recessed shoulder located below the upper surface and intersecting a marginal edge of the molded rubber recreational surface block; and a fastening strap interconnecting adjacently positioned recessed shoulders in adjacent molded rubber recreational surface blocks for securing same to each other.

2. A plurality of molded rubber recreational surface blocks each including:

an upper surface;

a honeycomb resilient supporting structure below the upper surface;

marginal edges surrounding the upper surface and honeycomb resilient supporting structure;

at least one recessed shoulder positioned below the upper surface and located adjacent one marginal edge;

at least one generally vertically directed through hole extending through the at least one recessed shoulder; and a flexible fastening device interconnecting the through hole of adjacently positioned recessed shoulders in adjacent molded rubber recreational surface blocks for securing same to each other, each fastening device comprising a fastening strap extending through one through hole of each of the adjacently positioned shoulders in adjacent molded rubber recreational surface blocks.

3. The molded rubber recreational surface blocks as defined in claim 2 in which there are two through holes in each recessed shoulder, and each fastening strap extends through at least one through hole of adjacently positioned recessed shoulders.

4. The molded rubber recreational surface blocks as defined in claim 3 in which one fastening strap is positioned in crossover superimposed position relative to the other fastening strap.

5. The molded rubber recreational surface blocks as defined in claim 2 in which there are a plurality of recessed shoulders each having at least one through hole in said one marginal edge.

6. The molded rubber recreational surface blocks as defined in claim 5 in which the marginal edges of each molded rubber recreational surface blocks surround a polygonally shaped upper surface and resilient supporting structure, and one of the plurality of recessed shoulders is located in proximity to the intersection of two marginal edges of adjacent molded rubber recreational surface blocks.

7. The molded rubber recreational surface blocks as defined in claim 2 including a cap for covering adjacently positioned recessed shoulders in adjacent molded rubber recreational surface blocks, the cap having an upper cap surface that is positioned in general alignment with the upper surfaces of adjacently molded rubber recreational surface blocks.

8. The molded rubber recreational surface blocks as defined in claim 7 in which the cap has shock absorbing elements that engage the adjacently positioned recessed shoulders of adjacent molded rubber recreational surface blocks.

9. A plurality of molded rubber recreational surface blocks each including:

a base of predetermined configuration having an upper surface, marginal side edges and a resilient supporting structure;

at least one recessed shoulder positioned below the upper surface and proximate one of the marginal side edges;

at least one through hole in the at least one recessed shoulder; and a fastening strap interconnecting the at least one through hole of adjacently positioned recessed shoulders in adjacently positioned molded recreational surface blocks for securing same to each other with the marginal side edges containing the at least one recessed shoulder in generally abutting relationship.

10. A plurality of molded rubber recreational surface blocks each including:

a base of predetermined configuration having an upper surface, marginal side edges and a resilient supporting structure;

at least one recessed shoulder positioned below the upper surface and proximate one of the marginal side edges;

a pair of through holes in the at least one recessed shoulders;

a pair of flexible fastening straps interconnecting the pair of through holes of adjacently positioned recessed shoulders in adjacently positioned molded recreational surface blocks for securing same to each other with the marginal side edges containing the at least one recessed shoulder in generally abutting relationship; and a cap for covering adjacently positioned recessed shoulders in adjacent molder rubber recreational surface blocks, the cap having an upper cap surface that is positioned in general alignment with the upper surfaces of adjacently molded rubber recreational surface blocks, and the cap having shock absorbing elements that engage adjacently positioned recessed shoulders of adjacent molded rubber recreational surface blocks.

11. A plurality of molded rubber recreational surface blocks each including:

a polygonally shaped base having an upper surface, marginal side edges and a resilient supporting structure;

at least one recessed shoulder positioned below the upper surface and proximate one of the marginal edges;

at least one other recessed shoulder positioned below the upper surface and proximate intersecting marginal edges of the polygonally shaped base;

at least one through hole in each of the aforementioned recessed shoulders;

a flexible fastening strap interconnecting the through holes of corresponding recessed shoulders proximate one marginal edge of adjacently positioned molded recreational surface blocks and a separate flexible fastening strap interconnecting the through holes of corresponding recessed shoulders intersecting marginal edges of the adjacently positioned molded recreational surface blocks in order to secure the marginal edges of the adjacently positioned recreational surface blocks in generally abutting relationship to each other; and a cap covering corresponding recessed shoulders in adjacently molded rubber recreational surface blocks, the cap having an upper cap surface that is positioned in general alignment with the upper surfaces of adjacently molded rubber recreational surface blocks.

12. The molded rubber recreational surface blocks as defined in claim 11 in which a plurality of recessed shoulders with at least one through hole are provided along at least said one marginal edge for cooperative fastening association with corresponding recessed shoulders of a similar constructed molded rubber recreational surface block.

13. The molded rubber recreational surface blocks as defined in claim 12 including a plurality of recessed shoulders each with at least one through hole along a plurality of marginal edges of the recreational surface block.

14. The molded rubber recreational surface blocks as defined in claim 13, including at least two through holes in each recessed shoulder.

15. The molded rubber recreational surface blocks as defined in claim 14 including a recessed shoulder with one through hole at each of the intersecting marginal edges of the molded rubber recreational surface block.

16. The molded rubber recreational surface blocks as defined in claim 11 in which the cap includes shock absorbing elements that engage the adjacently positioned recessed shoulders of adjacently molded rubber recreational surface blocks.

17. The molded rubber recreational surface blocks as defined in claim 16 in which the shock absorbing elements of the cap comprise outer shock absorbing elements that engage the adjacently positioned recessed shoulders outside of the fastening straps.

18. The molded rubber recreational surface blocks as defined in claim 17 in which the cap includes an inner shock absorbing element spaced upwardly from the adjacently positioned recessed shoulders that engages same only upon the application of sufficient compressive force.

19. The molded rubber recreational surface blocks as defined in claim 18 in which the inner and outer shock absorbing elements comprise vertical struts.

* * * * *